US005835110A

United States Patent [19]

Sasaki

[11] Patent Number: 5,835,110

[45] Date of Patent: Nov. 10, 1998

[54] INK JET HEAD AND INK JET PRINTER

[75] Inventor: Toyonori Sasaki, Anjo, Japan

[73] Assignee: Brother Kogyo Kabushiki Kaisha, Nagoya, Japan

[21] Appl. No.: 702,056

[22] Filed: Aug. 23, 1996

[30] Foreign Application Priority Data

Aug. 30, 1995 [JP] Japan ..... 7-246870

[51] Int. Cl.[6] ..... B41J 2/145; B41J 2/15; B41J 2/05

[52] U.S. Cl. ..... 347/40; 347/65

[58] Field of Search ..... 347/40, 62, 65, 347/85, 12, 42

[56] References Cited

U.S. PATENT DOCUMENTS

| | | | |
|---|---|---|---|
| 4,216,477 | 8/1980 | Matsuda et al. | 347/45 |
| 4,549,191 | 10/1985 | Fukuchi et al. | 347/71 |
| 5,016,028 | 5/1991 | Temple | 347/69 |
| 5,159,349 | 10/1992 | Endo et al. | 347/3 |
| 5,367,324 | 11/1994 | Abe et al. | 347/43 |
| 5,412,410 | 5/1995 | Rezanka | 347/15 |
| 5,421,071 | 6/1995 | Kanegae et al. | 347/71 |

FOREIGN PATENT DOCUMENTS

B-2-58-5785 2/1983 Japan .

*Primary Examiner*—N. Le
*Assistant Examiner*—Thinh Nguyen
*Attorney, Agent, or Firm*—Oliff & Berridge, PLC

[57] ABSTRACT

An ink jet head including: a plate member having left and right sides opposite each other, a front end and a rear end opposite each other, and a length from its front end to its rear end; two substrates each having a front end and a rear end opposite each other and a length from its front end to its rear end shorter than the length of the plate member, each substrate being attached to one of the left and right sides of the plate member so that the substrates sandwich the plate member therebetween and the rear end of the plate member protrudes beyond the rear ends of the substrates, each substrate being formed with a channel group including a plurality of ink-ejection channels extending from its front end to its rear end; and a manifold portion attached to the rear ends of the substrates and to left and right sides of the protruding rear end of the plate member and formed with two ink-supply channels each in fluid connection with the ink-ejection channels of a corresponding one of the channel groups.

15 Claims, 5 Drawing Sheets

INK JET HEAD AND INK JET PRINTER

BACKGROUND OF THE INVENTION

1. Field of the Invention

The present invention relates to an ink jet head and an ink jet printer for printing images on a recording sheet by ejection ink droplets from nozzles in the ink jet head.

2. Description of the Related Art

In recent years, ink jet printers have been drawing attention because of their high speed, high print quality, and comparatively simple configuration. Ink jet heads are formed with ink channels filled with ink and nozzles fluidly connecting the ink channels with the atmosphere. In one type of ink jet head, the volume in selected ink channels is rapidly decreased to eject an ink droplet from a corresponding nozzle. When the volume in the ink channels increases to its original size, ink is drawn into the ink channels from a ink introduction port, which fluidly connects the ink channel with an ink supply portion.

In order to produce an ink jet head capable of printing in full color, a plurality of heads, one for each different color of ink to be ejected, is provided together in a single head. To produce a more compact printer, the ink jet head needs to be produced in a small size with a high density. U.S. Pat. No. 4, 216,477 describes two ink jet heads formed integrally together from a single common covering plate and two base plates sandwiching the common covering plate. A plurality of ink channels, or pump chambers, and a common ink reservoir in fluid connection with the ink channels are formed in each of the base plates. Electrostrictive elements are provided in the ink channels. Ink from a supply pipe is supplied to the ink channels through the ink reservoir.

SUMMARY OF THE INVENTION

However, because both the ink channels and the ink reservoirs are formed in the base plates, processes for forming the channels and the ink reservoirs in the base plates need to be precisely performed and are therefore difficult.

To overcome the above-described problem, it is conceivable to further provide a separate manifold member, made from a resin or similar material, for fluidly connecting the ink channels with an ink supply portion.

This conceivable example will be described while referring FIGS. 1 and 2. FIG. 1 is a perspective view of a conceivable ink jet head. FIG. 2 is a cross-sectional view of the conceivable ink jet head. Two actuator plates 104, 105 are formed with channel groups 102, 103 respectively. The actuator plates 104, 105 are connected to opposite sides of a single plate member 101 so that front and rear ends of the actuator plates 104, 105 and the plate member 101 are in alignment with each other. A nozzle plate 206 formed with nozzles from which ink droplets are ejected is connected to the front ends of the actuator plates 104, 105 and the plate member 101. A manifold member 108 formed with ink channels 106, 107 for bringing the channel groups 102, 103 respectively into fluid connection with an ink supply portion (not shown in the drawings) is connected to the rear ends of the actuator plates 104, 105 and the plate member 101. With this configuration, the open rear ends of the channel group 102, 103 open into -the ink channels 106, 107 respectively. Adhesive for attaching the manifold member 108 to the actuator plates 104, 105 is coated to the rear end surface in the actuator plates 104, 105 and to a front end surface 109 of the manifold member 108. A silicone rubber that hardens at room temperature could be used as the adhesive.

However, with this conceivable configuration, the front end surface of the manifold member 108 and corresponding rear surfaces of the actuator plates 104, 105 to be adhered together must be extremely flat. If not, then spaces can be formed at the adhered surfaces or possibly adhesive can flow into the ink channels. It is difficult to obtain surfaces flat enough to prevent these problems. If spaces are formed between the channel groups 102 and 103, then different colors of ink will be mixed into adjacent ink channels. It is imperative that different colors of ink not be mixed and ejected together, but that the different colors of ink be ejected separately after the portion attached by adhesive has hardened.

It is an objective of the present invention to overcome the above-described problems and to provide an ink jet head and an ink jet printer with a simple, compact and easy-to-produce configuration and capable of high density recording in full color without different colored inks mixing together.

In order to achieve the above-described objectives, an ink jet head according to the present invention includes: a plate member having left and right sides opposite each other, a front end and a rear end opposite each other, and a length from its front end to its rear end; two substrates each having a front end and a rear end opposite each other and a length from its front end to its rear end shorter than the length of the plate member, each substrate being attached to one of the left and right sides of the plate member so that the substrates sandwich the plate member therebetween and the rear end of the plate member protrudes beyond the rear ends of the substrates, each substrate being formed with a channel group including a plurality of ink-ejection channels extending from its front end to its rear end; and a manifold portion attached to the rear ends of the substrates and to left and right sides of the protruding rear end of the plate member and formed with two ink-supply channels each in fluid connection with the channels of a corresponding one of the channel groups.

With this configuration, a head having nozzles for ejecting a plurality colors of ink can be obtained in a single assembled head. The single assembled head has a compact shape and high nozzle density. Further, adjacent channels are completely separated. Because the portion where adhesive is coated to connect the manifold member is not in direct contact with any ink channel, even if the connection of the manifold member is slightly imprecise, adjacent channels will remain separate and unconnected so that different colors of ink can be prevented from mixing together.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
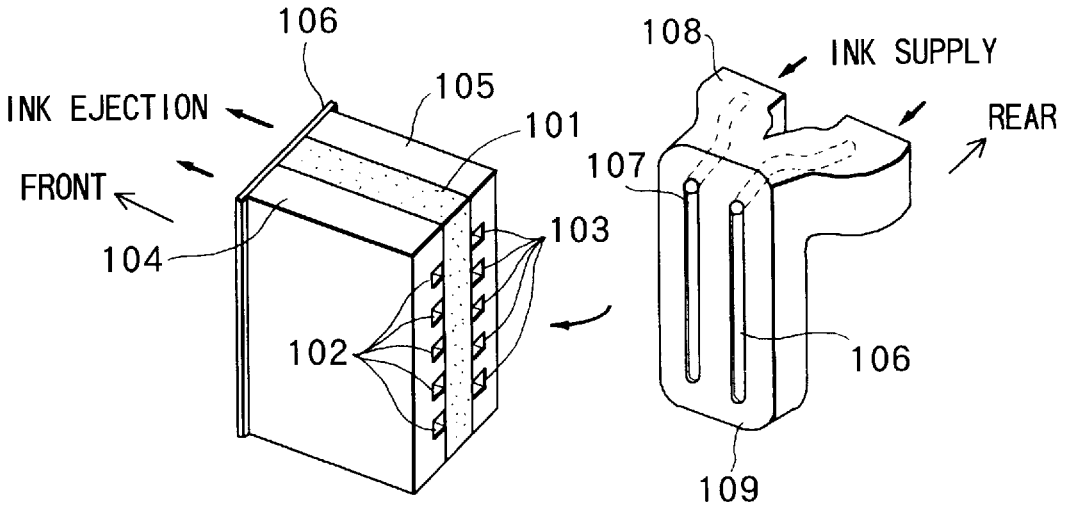
FIG. 1 is an exploded view showing a conceivable print head.
Figure 2:
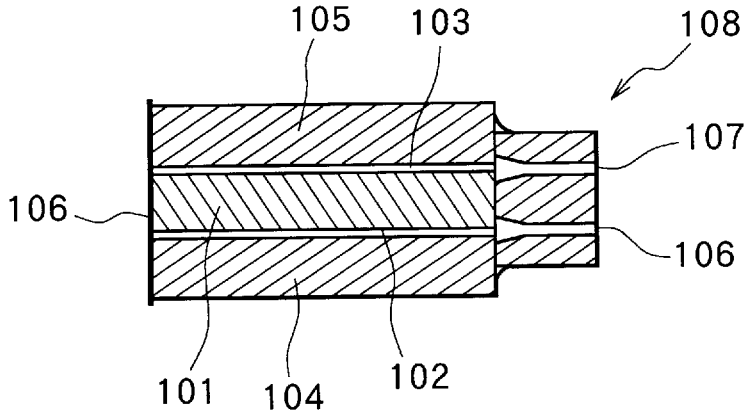
FIG. 2 is cross-sectional view showing the conceivable print head.

An ink jet head and an ink jet printer according to a first embodiment of the present invention will be described while referring to the accompanying drawings wherein like parts and components are designated by the same reference numerals to avoid duplicating description. It should be noted that the terms front, rear, right, and left refer to directions indicated by thus-labeled arrows in the drawings.

Figure 3:
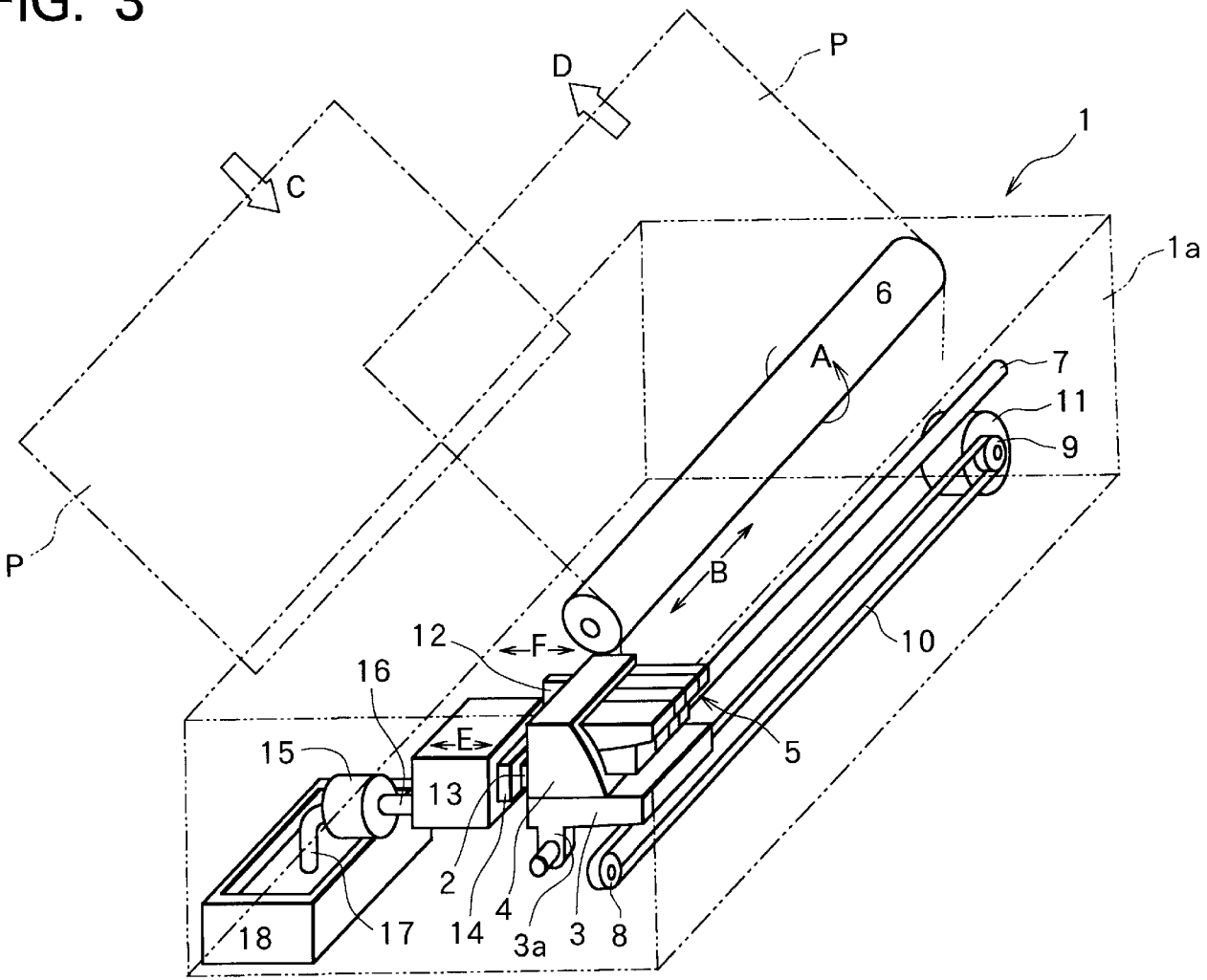
FIG. 3 is a perspective view showing an ink jet printer with a print head according to a first embodiment of the present invention.

FIG. 3 is a perspective view schematically showing a color ink jet printer according to the present embodiment. The color ink jet printer 1 includes an ink jet head 2 capable of ejecting four colors of ink (i.e., cyan, magenta, yellow, and black) onto a recording sheet such as a print sheet P; a head unit 4 provided integrally with the print head 2, an ink cartridge 5 provided on the head unit 4 for supplying four colors of ink to the print head 2, and a carriage 3 provided for supporting the print head 2 and on which the head unit 4 and the ink cartridge 5 are freely detachably mounted.

As will be described in further detail later, the print head 2 is provided with piezoelectric ceramic elements, which serve as energy-generating elements for generating energy to eject droplets of ink. When a voltage is applied to the piezoelectric ceramic elements, they deform in a pumping action which is used to eject ink droplets for printing characters and symbols on the print sheet P. It should be noted that the print head 2 can be replaced with a thermal head which uses thermal-electric elements instead of piezoelectric elements.

A carriage shaft 7 is supported on a frame of a housing 1*a* of the ink jet printer 1. A carriage shaft support portion 3*a* provided to the underside of the carriage 3 is mounted on the carriage shaft 7 so that the carriage 3 is reciprocally and linearly movable in a direction indicated by an arrow B in FIG. 3. An idle pulley 8 and a drive pulley 9 are provided at either end of the housing 1*a*. A belt 10 connected to the carriage 3 is suspended between the pulleys 8 and 9. When a motor 11 provided for driving the pulley 9 drives the pulley 9 to rotate, the carriage 3 is driven to move linearly and reciprocally along the carriage shaft 7. A freely rotatable platen roller 6 is provided in opposition to the front surface of the print head 2 in parallel with the carriage shaft 7. The print head 2 and the platen roller 6 form a print portion.

Although not shown in the drawings, a sheet supply cassette is provided to the upper-rear portion of the ink jet printer 1. The sheet supply cassette 1 transports a print sheet P in a direction indicated by an arrow C in FIG. 3. The platen roller 6 is driven to rotate in a direction indicated by an arrow A so that the print sheet P is transported between the print head 2 and the platen roller 6. After printing is completed, the print sheet P is discharged in a direction indicated by an arrow D. As they do not deal directly with the invention, components for supplying and transporting the print sheet P have been omitted from the drawings.

During operation of the ink jet print head 2, bubbles are generated within the print head 2. Also ink droplets can cling to the surface of the nozzle plate of the print head 2. This can result in defective ejection of ink droplets. A head cleaning member 12 such as a wiper for cleaning the print head 2 is provided at the side of the platen roller 6. A purge unit 13 for preventing such defective ejections and for returning to the print head 2 to a proper operating condition is provided at the side of the platen roller 6 in confrontation with the front side of a reset condition position of the print head 2. The purge unit 13 is capable of reciprocally moving in directions indicated by an arrow E. A cap 14 is provided to the tip of the purge unit 13. During purge operations, the purge unit 13 moves toward the print head 2 so that the cap 14 is brought into abutment with the print head 2 to cover the print head 2. A pump 15 generates a negative pressure within the cap 14 so that defective ink within the print head 2 is suctioned out of the nozzles and through pipes 16, 17. This cleans bubbles and other undesirable material from the nozzles and returns the print head 2 to proper operating condition. Suctioned defective ink is deposited in an accumulation tank 18.

Figure 4:
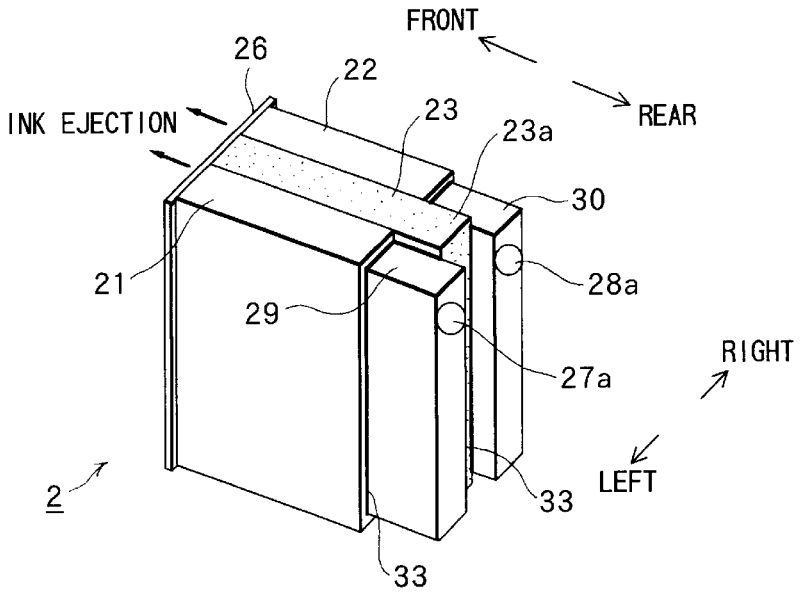
FIG. 4 is a perspective view showing the print head.
Figure 5:
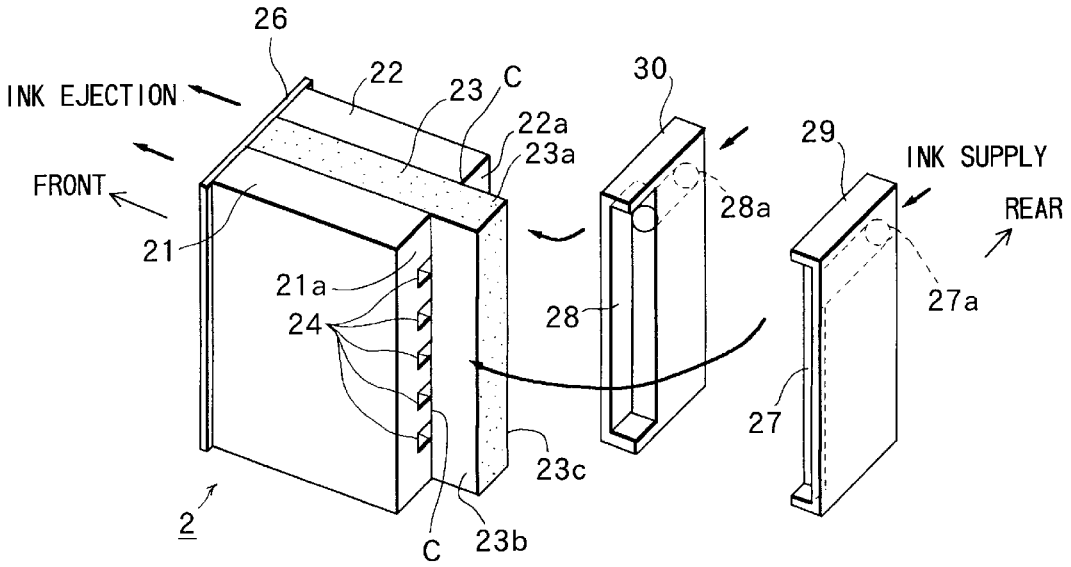
FIG. 5 is an exploded view showing the print head.
Figure 6:
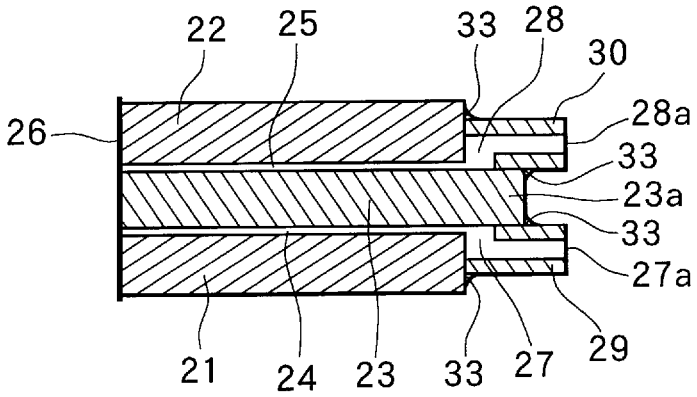
FIG. 6 is a cross-sectional view showing the print head.

FIG. 4 is a perspective view showing the print head 2 according to the first embodiment of the present invention. FIG. 5 is an exploded perspective view showing the print head shown in FIG. 4. FIG. 6 is a cross-sectional view showing the print head 2 of FIG. 4. The print head 2 is for ejecting two colors of ink. The head unit 4 includes two of these print heads 2 in alignment with each other. The print head 2 includes a plate member 23; and two substrates 21, 22, one attached to either side of the plate member 23 so that front surfaces of the plate member 23 and the two substrates 21, 22 are aligned flush with each other. Ink ejection channel groups 24, 25 are formed in the substrates 21, 22 respectively. Each channel group 24, 25 is formed with a plurality of ink channels. A nozzle plate 26 formed with nozzles from which ink droplets are ejected is attached to the aligned front surfaces of the substrates 21, 22. Manifold members 29, 30 formed from a resin or other appropriate material are connected to rear surfaces 21*a*, 22*a* of the substrates 21, 22. The manifolds 29, 30 are formed at their front ends with ink-supply channels 27, 28 and at their rear ends with ink-introduction ports 27*a*, 28*a*, which are fluidly connected with the ink-supply channels 27, 28 respectively. The manifold members 29, 30 bring the channel groups 24, 25 respectively into fluid communication with corresponding ones of the ink cartridges 5*a* through 5*d*, which serve as ink supply portions.

The plate member 23 extends beyond the rear surfaces 21*a*, 21*b* of the substrates 21, 22, thereby forming an protruding portion 23*a*. Opposite side surfaces 23*b*, 23*c* of the protruding portion 23*a* and the rear surfaces 21*a*, 21*b* of the substrates 21, 22 form therebetween corner portions C. The channel groups 24, 25 are brought into fluid communication with the ink-supply channels 27, 28 at corresponding corner portions C. The manifold members 29, 30 are adhered to the corner portion C using an adhesive applied to edges of the rear surfaces 21*a*, 22*a* and the side surfaces 23*b*, 23*c* and separated from the channel groups 24, 25 and from the ink-supply channels 27, 28. Then the manifold members 29, 30 are sealed using silicone rubber and the like at sealing areas 33 shown in FIG. 4 and 6.

It should be noted that the substrates 21, 22 include a plurality of partition walls forming the ink channels 24, 25, a portion of each partition wall being formed from polarized piezoelectric ceramic elements; and a plurality of electrodes formed to the partition walls at the piezoelectric elements and which when energized generate a drive electrical field orthogonal with the direction of polarization of the piezoelectric elements. The partition walls and electrodes serve together as energy-generating elements. Possible configurations of the substrates 21, 22 are described, for example, in U.S. Pat. Nos. 5,016,028 and 5,421,071, the disclosure of which is hereby incorporated by reference.

Figure 8:
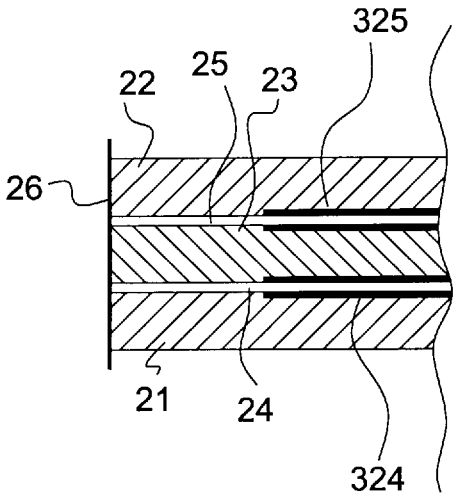
FIG. 8 is a cross-sectional view showing drive electrodes in ink channels.

Referring to FIG. 8, drive electrodes 324, 325 are shown formed in the apertures of ink channels 24, 25 along inner surfaces of the ink channels 24, 25. The drive electrodes 324, 325 can be formed over part of or the entire inner surface of each of the ink channels 24, 25 by vapor deposition using metallic materials such aluminum, nickel or the like. Drive electrodes 324, 325 form energy-generating elements within each of the ink channels.

Next, an explanation will be provided for operation of the print head 2 configured as described above. As mentioned previously, a pair of integrally formed print heads 2 each having two channel groups 24, 25 are provided in the ink jet printer 1. The ink-introduction ports 27*a*, 28*a* of the manifold members 29, 30 are each connected to a color ink cartridge 5. Colored ink passes through the ink-supply channels 27, 28 and is supplied to the channel groups 24, 25 of the print head 2. The piezoelectric ceramic elements provided in the substrates 21, 22 are driven based on print information from an external source. As a result, the volume of corresponding channels of the channel groups 24, 25 changes resulting in a pumping operation which ejects ink from the interior of desired channels of the channel groups 24, 25 through corresponding nozzles. Ink droplets ejected in this manner impinge on a print sheet P supplied to a position in confrontation with the print head 2 so that a full-color image can be printed.

In this way, the protruding portion 23*a* of the plate member 23 in the print head 2 completely separates the channel groups 24, 25 from each other. Also, the sealing areas 33 for preventing ink leaks do not directly contact the ink channels at any position. Therefore, even if the manifold members 29, 30 are attached to the substrates 21, 22 using adhesive with poor precision the channel groups 24, 25 and the ink-supply channels 27, 28, which are for transporting different colored inks, will not become fluidly connected. As a result, different colored inks will not be mixed together so that full color printing will be possible with complete division of different ink colors.

Figure 7:
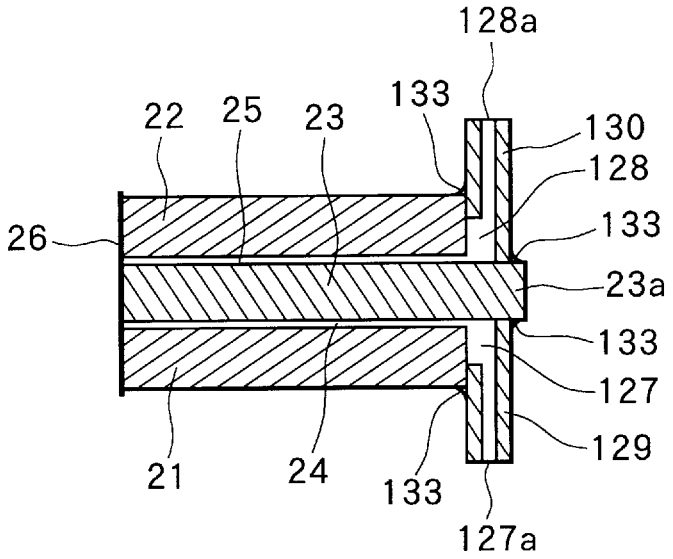
FIG. 7 is a cross-sectional view showing a print head according to a second embodiment of the present invention.

FIG. 7 is a cross-sectional view of a print head 2 according to a second embodiment of the present invention. Although the print head 1 of the first embodiment is configured with the manifold members 29, 30 connected so that the ink-supply channels 27, 28 extend in a direction substantially in parallel with the direction in which the channel groups 24, 25 extend, that is, parallel to the direction from the front to the rear of the substrates 21, 22, in the second embodiment, manifold members 129, 130 are attached so that ink-supply channels 127, 128 extend in a direction substantially perpendicular to the direction in which the channel groups 24, 25 extend. Because the plate member 23 of the second embodiment also includes the protruding portion 23*a*, the channel groups 24, 25 are completely separated from each other. Further, sealing areas 33 are not in direct contact with the channels of the channel groups 24, 25 so that the same good effects of the print head 1 of the first embodiment can be achieved.

As is clear from the above-described embodiments, by providing the protruding portion 23*a* to the plate member 23, the ink-supply channels 27, 28 can be freely designed either perpendicular to or parallel with the direction in which the channel groups 24, 25 extend.

While the invention has been described in detail with reference to specific embodiments thereof, it would be apparent to those skilled in the art that various changes and modifications may be made therein without departing from the spirit of the invention, the scope of which is defined by the attached claims.

Figure 9:
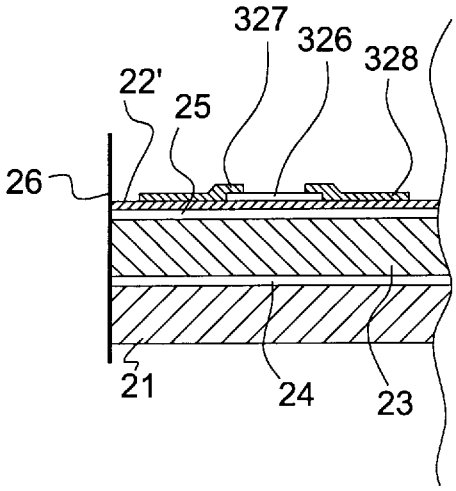
FIG. 9 is a cross-sectional view showing the mounting for a heat generating resistor.

For example, although the above-described embodiments disclose an ink jet head having piezoelectric ceramic elements provided to the substrates 21, 22, instead the present invention could be applied to another type of ink jet head such as a thermal jet head which uses force from expanding vapor bubbles to eject droplets, as disclosed, for example, in U.S. Pat. No. 5,159,349, the disclosure of which is hereby incorporated by reference. As shown in FIG. 9, a heat generating resistor 326 can be provided on an external wall of the partition wall 22' defining one of the ink channels 25. The heat generating resistor 326 can be formed as a film on the partition wall with electrodes 327, 328 provided on respective ends of the resistor 326 for applying a voltage to the resistor film in order to heat the resistor film. Further, although the manifold members 29, 30 were described as separate members in the above-described embodiments, an integral manifold member could be used instead.

In an ink jet head and an ink jet printer according to the present invention, two substrates are provided with energy-generating elements, which produce energy for ejecting ink. The two substrates are attached to either side of a plate member, thereby forming two sets of independent channel groups for ejecting different colored inks. Further, the plate member extends beyond the rear ends of the substrates. A manifold member which is formed with ink channels is attached to the corner portion formed between the side surface of the elongated portion of the plate member and the rear end surfaces of the substrates. This simple configuration allows provision of a compact head capable of full color printing at high density.

What is claimed is:

1. An ink jet head comprising:

a plate member having left and right sides opposite each other, a front end and a rear end opposite each other, and a length from the front end of the plate member to the rear end of the plate member;

two substrates each having a front end and a rear end opposite each other and a length from the front end of each substrate to the rear end of each substrate being shorter than the length of the plate member, each substrate being attached to one of the left and right sides of the plate member so that the substrates sandwich the plate member therebetween and the rear end of the plate member protrudes beyond the rear ends of the substrates, each substrate being formed with a channel group including a plurality of ink-ejection channels extending from the front end of each substrate to the rear end of each substrate; and a manifold portion attached along sealing surfaces to the rear ends of the substrates and to left and light sides of the protruding rear end of the plate member with two ink-supply channels being formed in said manifold portion adjacent said sealing surfaces and each in fluid connection with the ink-ejection channels of a corresponding one of the channel groups.

2. An ink jet head as claimed in claim 1, wherein the manifold portion includes two separate manifold members, each manifold member being attached to one of the left and right sides of the protruding rear end of the plate member and to the rear end of a corresponding one of the substrates.

3. An ink jet head as claimed in claim 2, wherein the ink-supply channels are formed in the manifold portion to extend parallel to a direction from the front to the rear of the substrates.

4. An ink jet head as claimed in claim 2, wherein the ink-supply channels are formed in the manifold portion to extend perpendicular to a direction from the front to the rear of the substrates.

5. An ink jet head as claimed in claim 1, wherein the manifold portion is an integral unit.

6. An ink jet head as claimed in claim 5, wherein the ink-supply channels are formed in the manifold portion to extend parallel to a direction from the front to the rear of the substrates.

7. An ink jet head as claimed in claim 5, wherein the ink-supply channels are formed in the manifold portion to extend perpendicular to a direction from the front to the rear of the substrates.

8. An ink jet head as claimed in claim 1, wherein the front ends of the substrates and the plate member are aligned flush with each other; and further comprising:

a nozzle plate attached to the front ends of the substrates and the plate member, the nozzle plate being formed with a group of nozzles for each of the channel groups, nozzles of the groups of nozzles being in fluid communication with the ink-ejection channels of a corresponding one of the channel groups.

9. An ink jet head as claimed in claim 8, wherein the manifold portion supplies ink from an ink supply portion to the nozzles via the ink-ejection channels.

10. An ink jet head as claimed in claim 1, further comprising energy-generating elements, one provided in each of the ink-ejection channels.

11. An ink jet head as claimed in claim 10, wherein each energy-generating element includes:

a partition wall formed in one of the substrates in fluid connection with one of the ink-ejection channels, at least a portion of the partition wall being formed from a piezoelectric element polarized in a polarization direction; and an electrode formed to the partition wall at the piezoelectric element and for generating a drive electrical field substantially orthogonal with the polarization direction of the piezoelectric element.

12. An ink jet head as claimed in claim 11, further comprising:

a carriage mounting the ink jet head; and a carriage drive system for reciprocally and linearly moving the carriage.

13. An ink jet head as claimed in claim 10, wherein each energy-generating element includes:

a partition wall formed in one of the substrates in fluid connection with one of the ink-ejection channels;

a resistor film formed to the partition wall; and a conductor film formed at opposite ends of the resistor film for applying a voltage to the resister film, thereby heating the resistor film.

14. An ink jet head as claimed in claim 1, further comprising:

a carriage mounting the ink jet head; and a carriage drive system for reciprocally and linearly moving the carriage.

15. An ink jet head as claimed in claim 1, wherein said left and right sides of the plate member each form a side of each of the plurality of the ink-ejection channels formed in the substrate attached to the respective side of the plate member.

* * * * *